US007252449B2

(12) United States Patent
Carroll

(10) Patent No.: US 7,252,449 B2
(45) Date of Patent: Aug. 7, 2007

(54) RETRACTABLE WRITING TOOL AND SELF SEALING VALVE

(76) Inventor: Craig David Carroll, 1210 Night Star Way, Anaheim Hills, CA (US) 92808

( * ) Notice: Subject to any disclaimer, the term of this patent is extended or adjusted under 35 U.S.C. 154(b) by 0 days.

(21) Appl. No.: 10/789,698

(22) Filed: Feb. 27, 2004

(65) Prior Publication Data

US 2005/0191111 A1 Sep. 1, 2005

(51) Int. Cl.
*B43K 5/16* (2006.01)

(52) U.S. Cl. ..... 401/108; 401/107

(58) Field of Classification Search ..... 401/99, 401/107, 108

See application file for complete search history.

(56) References Cited

U.S. PATENT DOCUMENTS

| | | | | |
|---|---|---|---|---|
| 3,796,501 | A * | 3/1974 | Zepell | 401/106 |
| 5,022,773 | A * | 6/1991 | Waldinger et al. | 401/107 |
| 6,033,141 | A * | 3/2000 | Blaustein et al. | 401/107 |
| 7,059,796 | B2 * | 6/2006 | Lewis et al. | 401/107 |

* cited by examiner

*Primary Examiner*—David J. Walczak
(74) *Attorney, Agent, or Firm*—John Karl Buche

(57) ABSTRACT

A capless retractable writing tool applicable to neutral and volatile writing fluids and capable of self sealing.

18 Claims, 9 Drawing Sheets

RETRACTABLE WRITING TOOL AND SELF SEALING VALVE

BACKGROUND OF THE INVENTION

The present invention is in the field of retractable writing tools, and more particularly, to writing tools that employ volatile inks that evaporate when exposed to air. Still more particularly, the present invention relates to writing tools having a self sealing valve that seals the writing tip from outside air and prevents the release of vapor fluid from within the valve. The self sealing valve also allows the writing tip to be protracted through the valve, and retracted back into the valve.

Existing writing tools that use volatile fluids include a cartridge that holds the fluid supply and secures the writing tip, and a cap that protects the fluids from evaporating. In use the cap is removed from the cartridge and stored on the back end of the writing tool. Hence, existing writing tools that use volatile fluids generally require two free hands to operate and tightly sealing caps to minimize the writing tips exposure to air. Failure to replace the cap tightly from this type of dispenser causes the fluid to evaporate, and dry up the fluid after a short time. To open and store the cap requires two free hands, one to remove the cap and the second to hold the body securely. The use of two free hands to remove the cap from the body may be undesirable to the user if they only have one free hand.

Many writing tools fall into two categories: a retractable type and a non-retractable type. The distinction between these two types of writing tools usually depends on the type of fluid that is used. The fluid in the retractable type has a low evaporation rate so that even though the tip is exposed to the air, the writing tip will not dry out. In contrast, the fluid in the non-retracting type has a higher evaporation rate than the fluid in the retractable type so that the fluid can evaporate through the tip and into the air. This can cause the tip in the non-retractable type to dry out. Thus, a cap is needed to seal the tip of the non-retractable writing instrument from the air.

A ballpoint pen is a good example of a retractable writing tool that includes an internal mechanisms to allow the tip to move back and forth inside the front cowling of the pen. Retractable writing tools are convenient to use because with one hand, a user can press and release the plunger back and forth to cause the tip to move back and forth. Once the tip is in the retracted position, the tip is protected from accidentally drop and cannot accidentally write onto a surface.

A permanent marker is a good example of a non-retractable writing instrument that needs a cap to seal the tip from outside air. If the cap is left off the marker, lost or not secured properly, the tip would eventually dry out. This can shorten the life of the marker. As such, users have to remember to put the cap back on after each use. For users, however, remembering to put the cap back on after each use can be inconvenient and inefficient. Besides being inconvenient and inefficient, misplaced caps can be a choking hazard for small children.

To eliminate the need for a cap, others have designed a writing tool with a retractable tip that is sealed from the outside air when in the retracted position. The tip is sealed by incorporating some type of a sealing cover around the tip that opens to allow the tip to move in and out of the sealing cover. These sealing covers however, are complex and fail to seal the tip from outside air. In addition, the sealing covers fail to eliminate the loss of vapor fluid that is built up within the sealing covers from escaping through the openings when the writing tip is retracted back into the sealing covers. The sealing covers are also made of materials that are permeable so that vapor fluid can escape through the walls of the sealing covers as well.

In addition to the problem with the tip being exposed to air and vapor fluid escaping through the openings of the sealing cover, current retractable writing tool designs with sealing covers use permeable materials in the fabrication of the sealing covers. Accordingly, there is a need for a retractable writing tool that can seal the tip in the retracted position from outside air and the loss of vapor fluid that is built up within the sealing cover when the writing tool is in the retracted position.

BRIEF SUMMARY OF THE INVENTION

The present invention is intended to provide a capless writing tool applicable to neutral and volatile writing fluids and capable of self-sealing and substantially preventing vapor fluid from evaporating through the valve when the tip is in the retracted position. The present invention includes a front cowling with an opening to allow the tip to move in and out of the opening. Adjacent to the front opening and within the front cowling is a valve that substantially seals the tip from outside air, and prevents the release of vapor pressure from within the valve when the tip is in a retracted position. The writing instrument also includes a back body with a back opening. Disposed within the back opening is a plunger that is adapted to move back and forth axially. When the plunger is forced into the back body cavity, there is provided a mechanism for locking the tip against the urging force of a compression spring so as to hold the tip in the writing state, the mechanism unlocks the tip when the plunger is forced further into the back body cavity and the tip is retracted back into the valve for storage. The valve includes a front end and a back end, where the front end is adapted to open to allow the tip to extend there through. To open the front end may have a concave configuration or profile with a slit. The slit can be cut or formed into the valve. The front end of the valve may have a groove formed along the elongated axis. The groove may have a thin layer of material between the inner and outer wall of the front end of the valve, the groove is pierced and forms a slit when the tip of the writing tool is forced through it by pushing down on the plunger at the back of the barrel and protracting the tip of the writing tool. The front end may have a planner or convex configuration or profile with an elongated axis. To enhance proper closure of the slit and to increase the amount of vapor pressure the slit can withstand, a tension device may be provided around the front end to substantially seal the slit when the tip is in the retracted position. An array of ribs along the outer or inner circumference of the front end of the valve will also enhance proper closure of the slit. In addition, the inner circumference of the front cowling may be about the same or slightly less than the circumference around the front end of the valve to support the closure of the slit. The back end of the valve has a hole adapted to substantially seal around the cartridge that the tip is attached to. To increase the amount of vapor pressure the back end of the valve can withstand, the interference fit between the hole and cartridge can be increased. In the retracted position, the tip is between the front and back ends of the valve to substantially seal the tip from the outside air, and to prevent the release of vapor pressure from within the valve, thereby eliminating the need for a cap.

With capped writing tools the vapor fluid from within the reservoir will evaporate through the writing tip and into the enclosure of the cap. Some of the molecules from the vapor fluid will be reabsorbed by the tip and feeder and return to a fluid state. Some of the molecules that make up the vapor fluid will condense within the enclosure of the cap until equilibrium is reached and the enclosure is saturated. The pressure within the enclosure when saturated in a capped writing tool can range from 0 to 4 pounds per square inch. If the capped writing tool is not sealed to withstand a pressure level of 0 to 4 pounds per square inch, the vapor fluid from within the reservoir will evaporate into the atmosphere. If the material used to fabricate the cap is permeable, the vapor fluid will pass through the material and into the atmosphere.

To solve the above mentioned problem, a capless writing tool is provided comprising a valve having a front end and a back end that substantially seals the tip from outside air, and prevents the release of vapor pressure from within the valve when the tip is in a retracted position. The valve for the present invention may be made from a material that is impermeable to outside air and vapor fluid. The valve may be treated by a secondary process known as fluorination, whereby the valve is introduced to the element fluorine to further reduce or eliminate permeation of the vapor fluid. The valve may be made of a material that is durable so that the slit will not wear out after the tip is moved in and out many times.

Other systems, methods, features, and advantages of the invention will be or will become apparent to one with skill in the art upon examination of the following figures and detailed description. It is intended that all such additional systems, methods, features, and advantages be included within this description, be within the scope of the invention, and be protected by the accompanying claims.

The present invention disclosed herein provides a retractable writing tool and self-sealing valve that allows for one hand operation, by push button, to retract and protract a tip stored within the valve.

This design is simple to manufacture and assemble enabling high volume low-cost manufacturing. These are requirements to be a competitive and saleable product in the market. In addition, the design has the enhanced feature and added value, to the end consumer, of being capless, child safe, self-sealing and relatively inexpensive to manufacture, and thus purchase.

BRIEF DESCRIPTION OF THE DRAWINGS

The invention can be better understood with reference to the following figures. The components in the figures are not necessarily to scale, emphasis instead being placed upon illustrating the principles of the invention. Moreover, in the figures, like reference numerals designate corresponding parts throughout the different views.

DETAILED DESCRIPTION OF THE INVENTION

Figure 1:
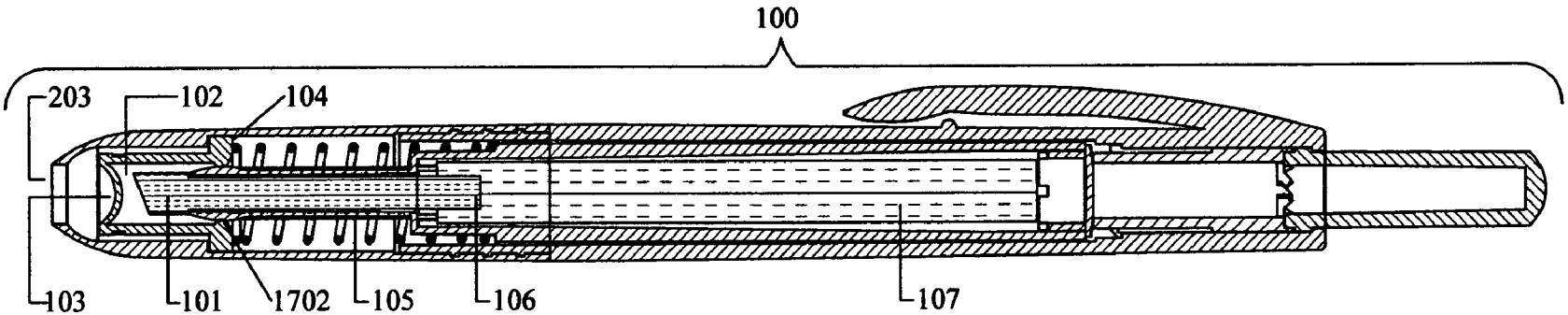
FIG. 1 is a cross-sectional view of a retractable writing tool in the retracted state constructed in accordance with one embodiment of the present invention showing its component parts in operative assembled relationship.

FIG. 1 illustrates the cross-sectional view of the writing tool 100 in a retracted position. In the retracted position, the tip 101 is within the enclosure 102 with the front end 103 substantially forming a seal, and the back end 104 substantially forming a seal around the second leading section 1702. The back tip 106 makes contact with the feeder 107 so that the fluid stored in the feeder 107 conveys through the tip 101. In the retracted position, as the fluid evaporates from the tip 101, the vapor is substantially sealed within the enclosure 102.

Figure 2:
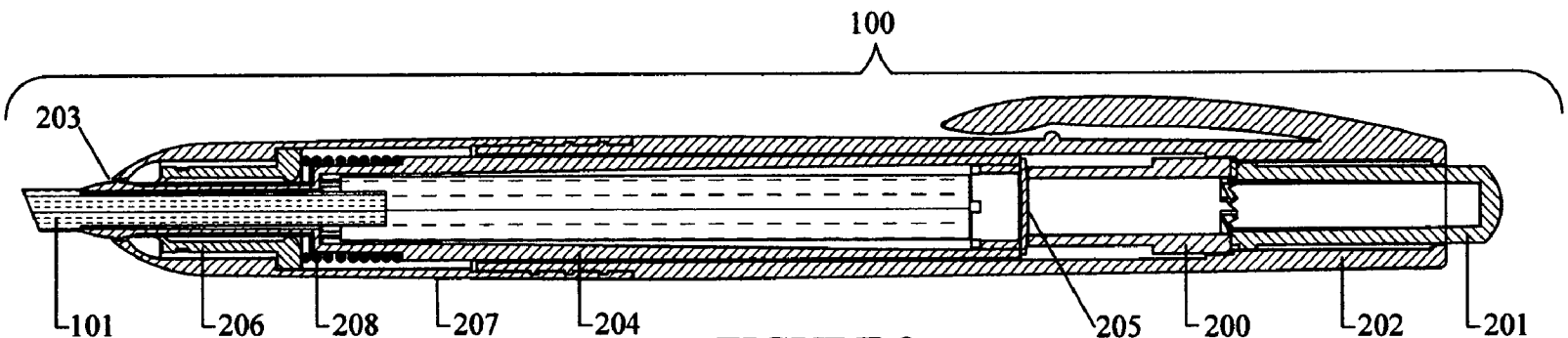
FIG. 2 is a cross-sectional view of a retractable writing tool in the protracted state constructed in accordance with one embodiment of the present invention showing its component parts in operative assembled relationship.

FIG. 2 illustrates the cross sectional view of the writing tool 100 in the protracted position. The writing tool 100 includes a gear 200 that works with the plunger 201 and the rear barrel 202 to lock the plunger 201 in the retracted position or the protracted position. To extend the tip 101 outside the opening 203, the plunger 201 is activated or pushed towards the rear barrel 202. This causes the cartridge 204, cartridge plug 205, feeder 107, and the tip 101 to move forward towards the opening 203. As the tip 101 is pushed against the front end 103 of valve 206, the front end 103 opens to allow the tip 101 to pass through the opening 203 of the front barrel 207. The compression spring 208 resist against the pushing force until the gear 200 engages and locks in the protracted position. The tip 101 is now ready for the user to apply the fluid to a surface.

Figure 3:
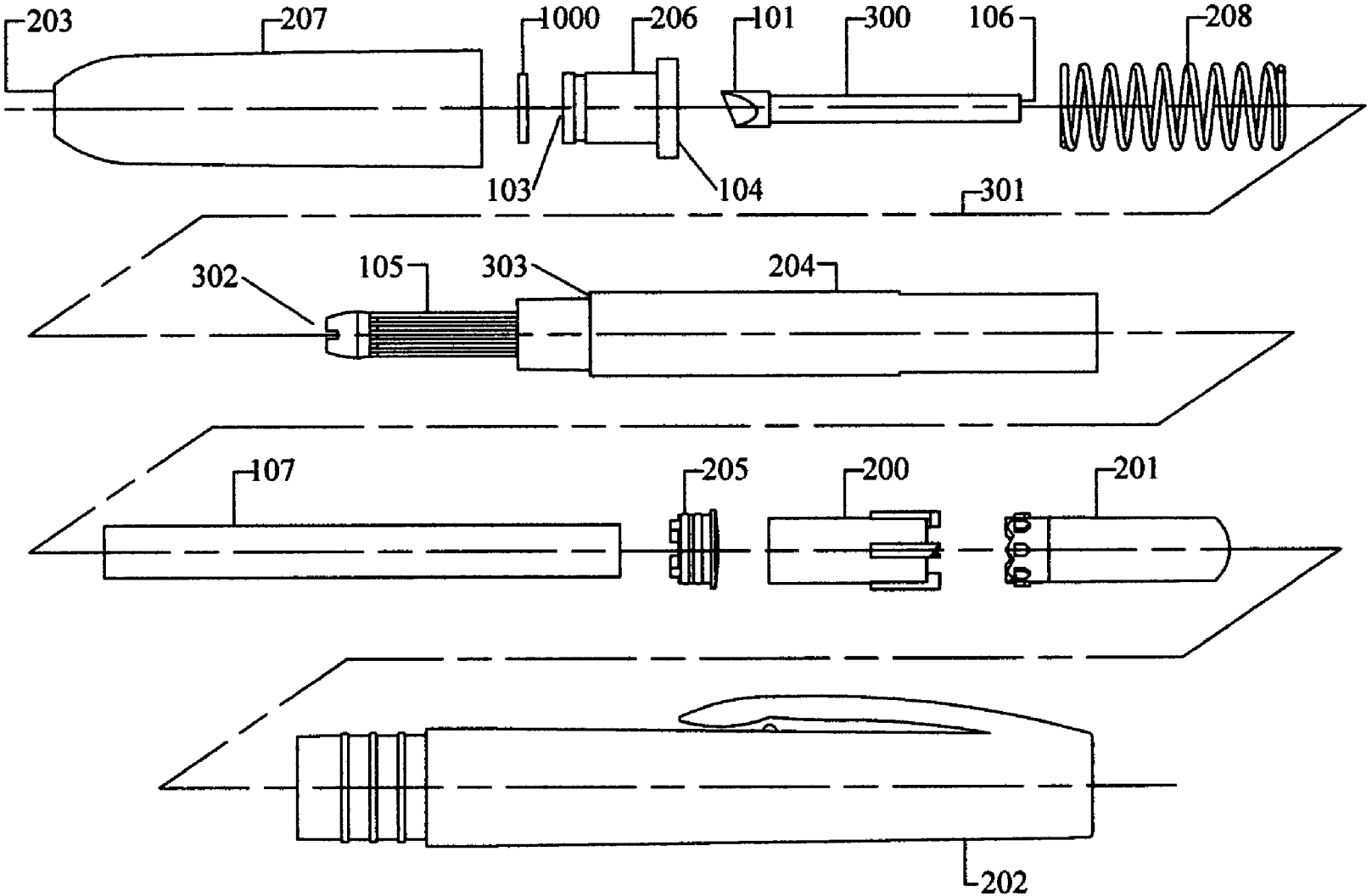
FIG. 3 illustrates a writing tool that is disassembled.

FIG. 3 illustrates the interior components of the writing tool 100. The writing tool 100 includes a valve 206 adapted to fit within the front barrel 207 adjacent to the opening 203. The valve 206 has a front end 103 and a back end 104 forming an enclosure 102 within the valve 206. The enclosure 102 is adapted to receive the tip 101 to substantially seal tip from the outside air and prevent the release of vapor pressure from within the enclosure 102 when the tip 101 is in a retracted position. The tip 101 is coupled to a rod 300 along a longitudinal axis 301. The tip 101 may be a separate component from the rod 300 or a unitary piece.

The writing instrument 100 also includes a cartridge 204 adapted to couple to a cartridge plug 205. The cartridge 204 and cartridge plug 205 are adapted to enclose a feeder 107. The feeder 107 is adapted to store writing fluid that conveys through the tip 101. The capillary relationship among the feeder 107 and tip 101 causes the writing fluid to convey from the feeder 107 to the tip 101. The cartridge 204 has an elongated portion 105 with a first opening 302 adapted to receive the tip 101. This allows the tip 101 to make contact with the feeder 107 to convey the writing fluid to the tip 101. The cartridge 204 has a back flange 303 adapted to associate with a compression spring 208. The elongated portion 105 of the cartridge 204 may be inserted through the compression spring 208 such that the compression spring 208 is positioned between the first opening 302 and the back flange 303.

Figure 4:
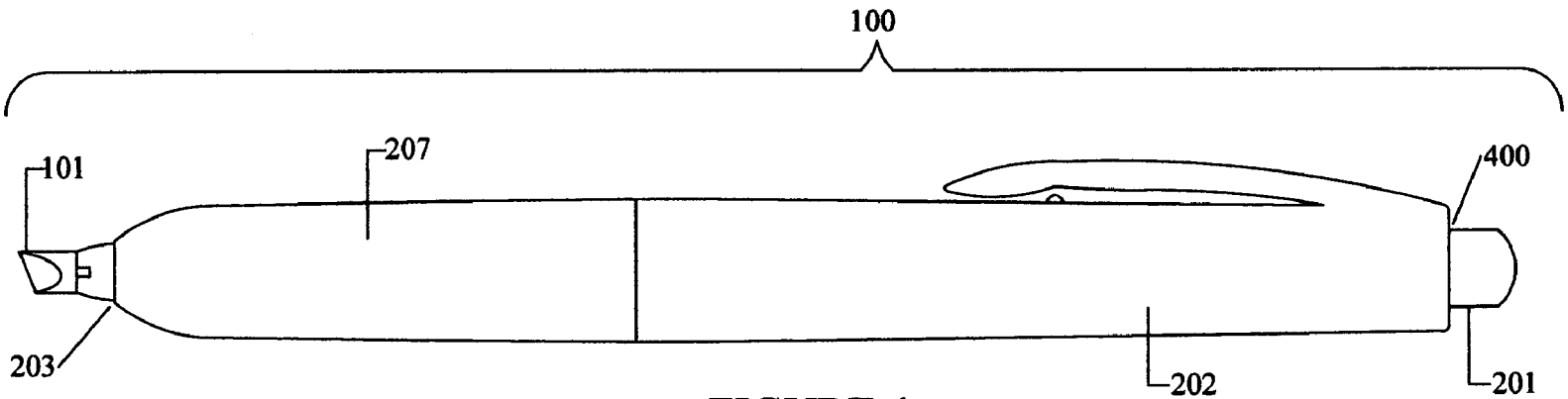
FIG. 4 illustrates a side view of the writing tool in a protracted state.

FIG. 4 illustrates a writing tool 100 in a protracted position with a tip 101 extending from the front barrel 207. The front barrel 207 has an opening 203 to allow the tip 101 to move between a protracted position and a retracted position. The writing tool 100 also has a rear barrel 202 with a rear opening 400 at the back end to allow a plunger 201 to extend between the protracted position and the retracted position. In the protracted position, the plunger 201 is pressed down relative to the rear barrel 202 that causes the tip 101 to extend through the opening 203 and extend from the front barrel 207.

Figure 5:
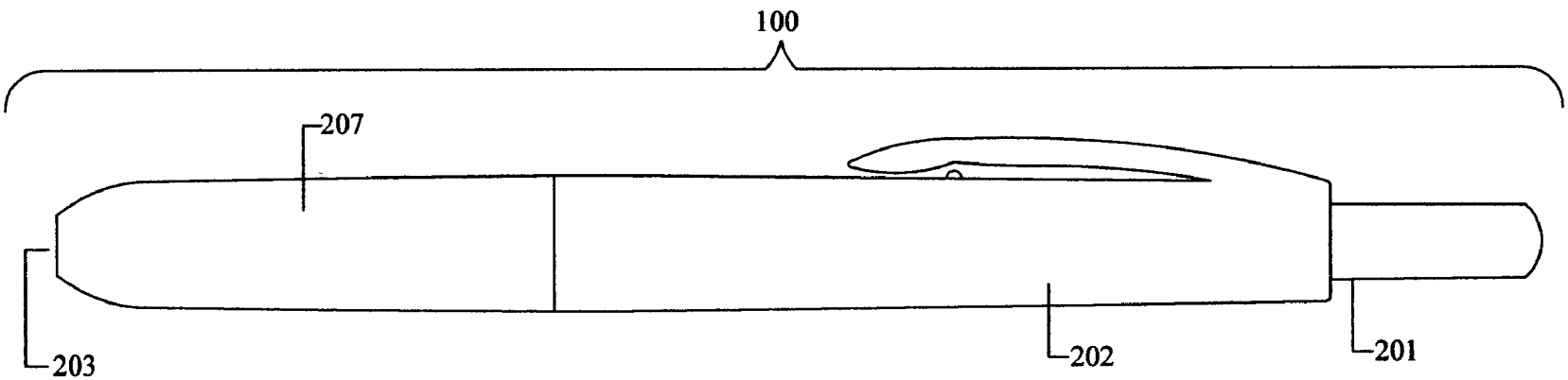
FIG. 5 illustrates a side view of the writing tool in a retracted state.

FIG. 5 illustrates the writing tool 100 in a retracted position where the tip 101 is inside the front barrel 207. In the retracted position, the plunger 201 further extends from the rear barrel 202 that causes the tip 101 to retract into the front barrel 207 by moving back into the opening 203. As such, by activating the plunger 201 between the retracted and protracted positions, the tip 101 is moved correspondingly between the retracted and protracted positions as well.

Figure 6:
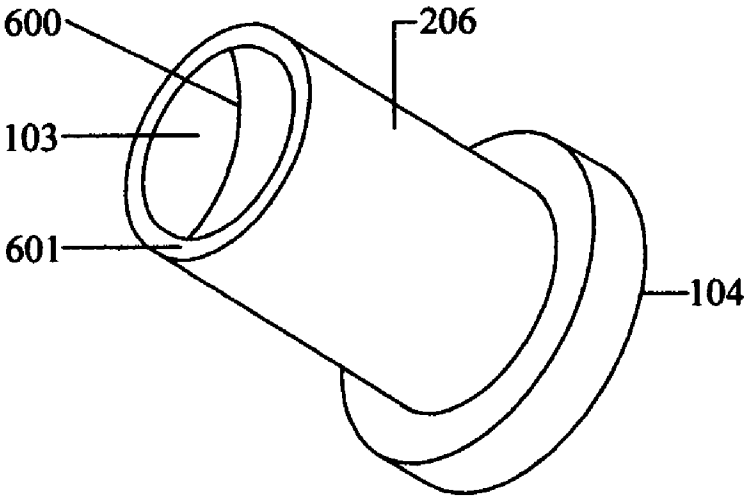
FIG. 6 is a front perspective view of a valve.

FIG. 6 illustrates a perspective view of the valve 206 with the front end 103 and the back end 104. The front end 103 may have a concaved shape profile with a slit 600 that opens to allow the tip 101 to pass there through. The concave shape profile provides support around the slit 600 to enhance proper closure of the slit 600 when the tip 101 moves back into the valve 206. The width of the slit 600 may extend from edge to edge of the circumference 601. In this example, the circumference 601 of the front end 103 may be circular.

Figure 7:
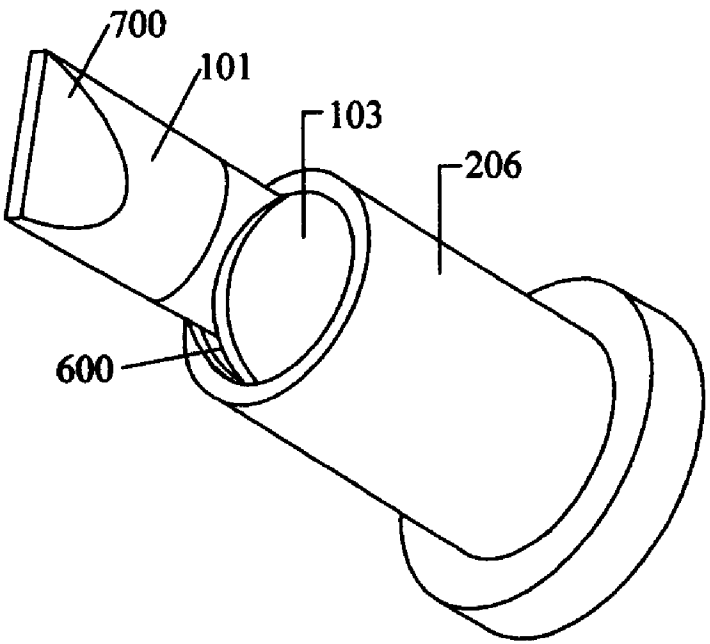
FIG. 7 is a front perspective view of a valve with a tip extended past the front end and through a slit.

FIG. 7 illustrates a perspective view of the valve 206 with the tip 101 extended past the front end 103 and through the slit 600. The valve 206 may be made of a material that is durable and flexible so that the slit 600 will not wear out after many cycles of the tip 101 moving in and out of the slit 600. The material should have low permeability to vapor and air to seal the tip 101. The type of material used depends on the type of fluid that is used. For water-based fluids with a lower evaporation rate than an alcohol-based writing fluid, silicone may be used to form the valve 206, but TPE (thermoplastic elastomer), natural rubber, synthetic rubber (e.g. isoprene), and TPV (thermoplastic vulcanizate) material including butyl rubber crossed linked with polypropylene are also preferred. A variety of methods may be used to form the valve 206 such as injection molding, blow molding, extrusion molding, and other methods known to one skilled in the art.

For alcohol-based fluids with higher evaporation rate, butyl rubber and synthetic rubber (e.g. isoprene), may be compression molded or other methods known to one skilled in the art may be used to form the valve 206. Alternatively, the valve 206 may be formed from thermoplastic elastomer with thermoplastic rubber that has low permeability to vapor. In addition, the valve 206 may be formed from thermoplastic elastomer and treated with fluorine to further reduce permeation.

Figure 8:
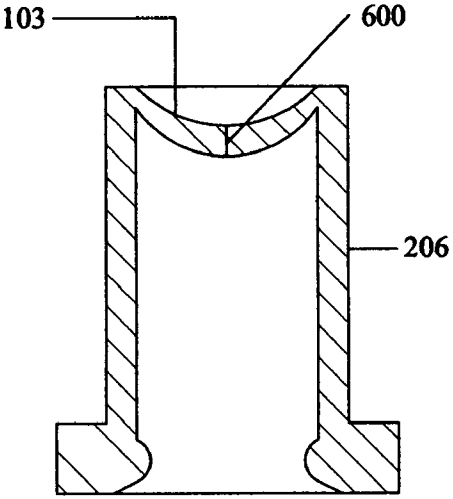
FIG. 8 is a cross sectional view of a valve.

FIG. 8 illustrates a cross sectional view of the valve 206. Most preferably, the radius of curvature of the front end 103 is between 0 millimeters and 4 millimeters. In addition, a further dimension that is most preferable is the thickness of the concaved shape profile of the front end 103, may be between about 0.3 millimeters and about 2 millimeters. These dimensions have been found to be very important in providing flexion of the front end 103 and opening and closing of slit 600. It is preferred that the valve 206 be formed from a single piece of elastomeric material to facilitate easy insertion into the front barrel 207.

Figure 9:
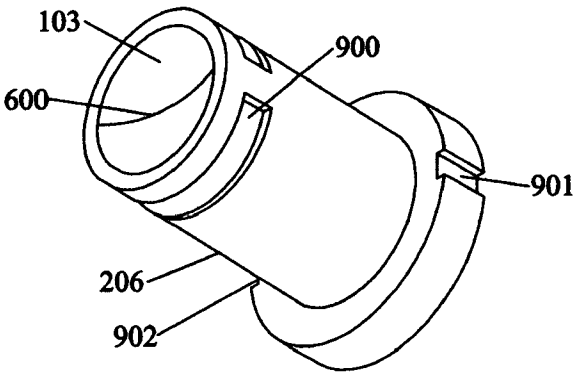
FIG. 9 is a perspective view of a valve having a recess around the front end adapted to receive a tension device.
Figure 10:
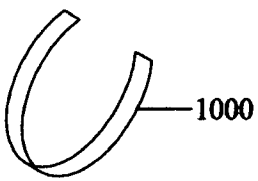
FIG. 10 is a perspective view of a tension device.

FIG. 9 illustrates a valve 206 having a recess 900 around the front end 103 adapted to receive a tension device 1000 (FIG. 10). As the tip 101 retracts into the valve 206, the tension device 1000 applies compression force to the slit 600 to add additional pressure to close the slit 600. A variety of tension devices may be used around the front end 103, such as an elastic band and a ring. FIG. 10 illustrates a tension device 1000 made of metal or plastic to apply compression force to the front end 103.

Figure 11:
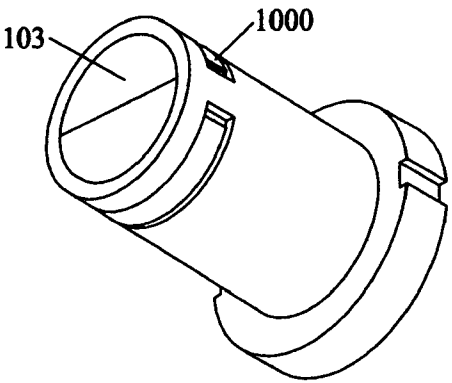
FIG. 11 is a perspective view of a valve having a planner face and a tension device around the front end.
Figure 12:
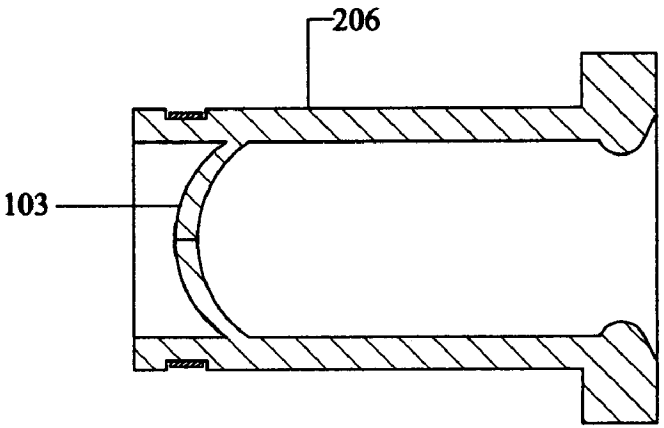
FIG. 12 is a cross sectional view of a valve having a convex face.

With the tension device 1000, the front end 103 may have other configurations. FIG. 11 illustrates the tension device 1000 around the front end 103 having a substantially planner face. FIG. 12 illustrates the front end 103 having a convex configuration.

Figure 13:
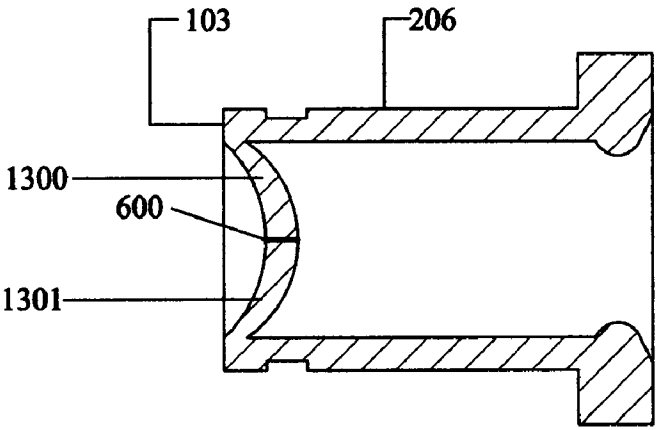
FIG. 13 is a cross sectional view of a valve and a slit having lips thicker than the thickness of the rest of the first end.

FIG. 13 is a cross sectional view of the valve 206 and the slit 600 having lips 1300 and 1301. The lips 1300 and 1301 may be thicker at the slit 600 than the thickness of the rest of the front end 103 to allow for greater surface area contact between the lips 1300 and 1301 for better sealing. Other lip configurations may be provided for better seal between the lips 1300 and 1301.

Figure 14:
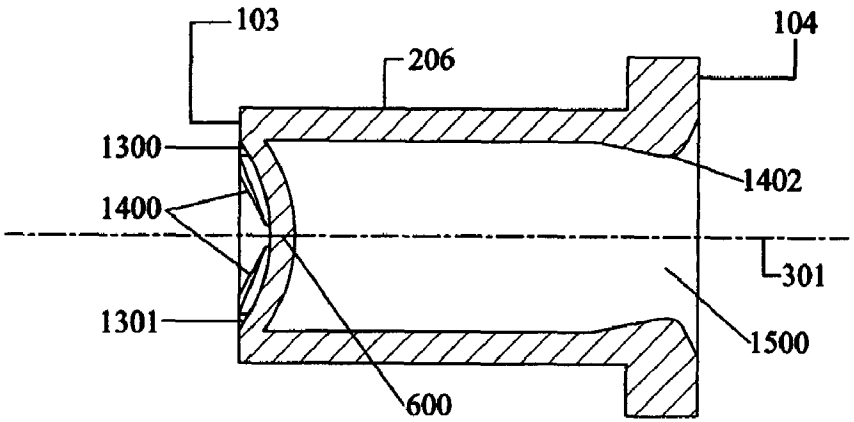
FIG. 14 is a cross sectional view of a valve having an array of ribs within and around the first end.

FIG. 14 is a cross sectional view of the front end 103 having an array of ribs 1400 around the front end 103 to provide addition support around the slit 600 to close the slit 600, when the tip 101 moves back into the retracted position. The ribs may also be formed on the interior lips 1300 and 1301 to provide additional support around the slit 600 to close the slit 600, when the tip 101 moves back into the retracted position. The ribs around the slit 600 may be positioned so that the ribs are off-axis to the longitudinal axis 301 of the slit 600 to provide added support to the closure of the slit 600.

Figure 15:
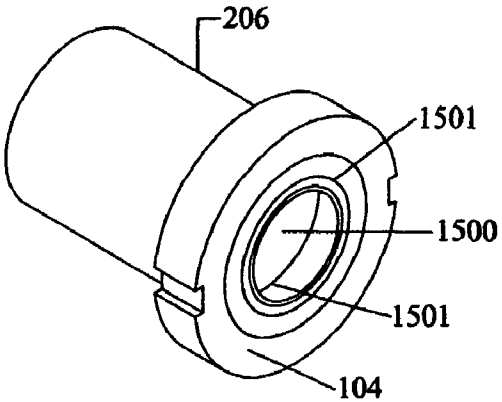
FIG. 15 is a back perspective view of a valve.

FIG. 15 illustrates the back end 104 of the valve 206. The back end 104 has a hole 1500 adapted to receive the elongated portion 105 with the tip 101 inside. As the tip 101 moves between the retracted and protracted positions, the elongated portion 105 correspondingly moves axially in and out of the hole 1500. The edges 1501 around the hole 1500 may be beveled to minimize the friction between the back end 104 and the elongated portion 105. As further illustration in FIG. 14, the hole 1500 around the back end 104 may have a concave edge 1402 to minimize the friction with the elongated portion 105.

Figure 16:
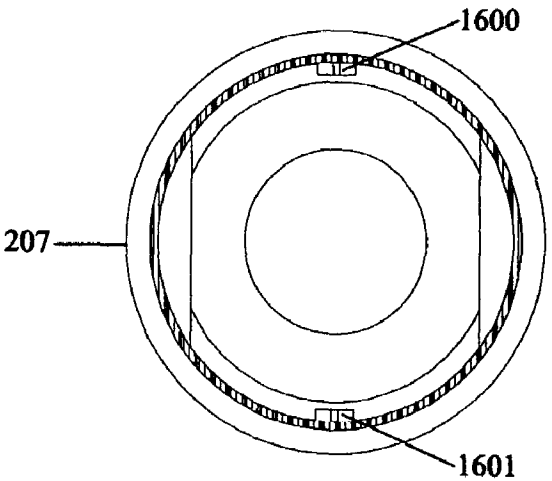
FIG. 16 is a cross sectional view of the front barrel having tabs.

FIG. 16 is a cross sectional view of the front barrel 207 having tabs 1600 and 1601 that are adapted to engage with the cavities 901 and 902 of the valve 206 (FIG. 9). During assembly the valve 206 is inserted into the front barrel 207, the tabs 1600 and 1601 guide the valve 206 to a predetermined position within the front barrel 207. This in turn allows the slit 600 to be positioned at a predetermined position as well.

Figure 17:
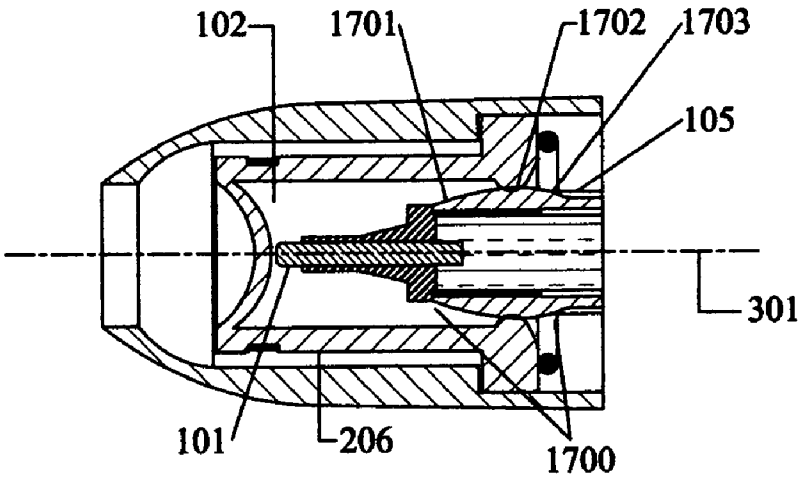
FIG. 17 is an enlarged cross-sectional view of a tip and a cartridge in relation to a valve in the retracted position.

FIG. 17 illustrates an enlarged cross-sectional view of the tip 101 in relation to the valve 206 in the retracted position.

The leading section 1700 of the elongated portion 105 may have three sections, a first leading section 1701, a second leading section 1702, and a third leading section 1703, where the second leading section 1702 is between the first and third leading sections 1701 and 1703. In the retracted position, the first leading section 1701 is within the enclosure 102, the second leading section 1702 substantially forms a seal with the back end 104, and the third leading section 1703 is on the rear side of the back end 104. The first leading section 1701 tapers downward towards the first opening 302 along the longitudinal axis 301 to make it easier for the first leading section 1701 to pass through the slit 600. The second leading section 1702 forms a seal with the back end 104 in the retracted position. The circumference around the second leading section 1702 may be about the same or slightly greater than the hole 1500 in the back end 104 to form a seal.

FIG. 17 illustrates another embodiment of the tip 101 that is adapted to engage within the first opening 302 of cartridge 204. A variety of different types of tips known to one skilled in the art can be adapted to the first opening 302 of cartridge 204. In addition, the cartridge 204 may be of a free fluid type adapted to receive a tip embracing a writing ball, similar to a cartridge and tip found in a ballpoint pen.

Figure 18:
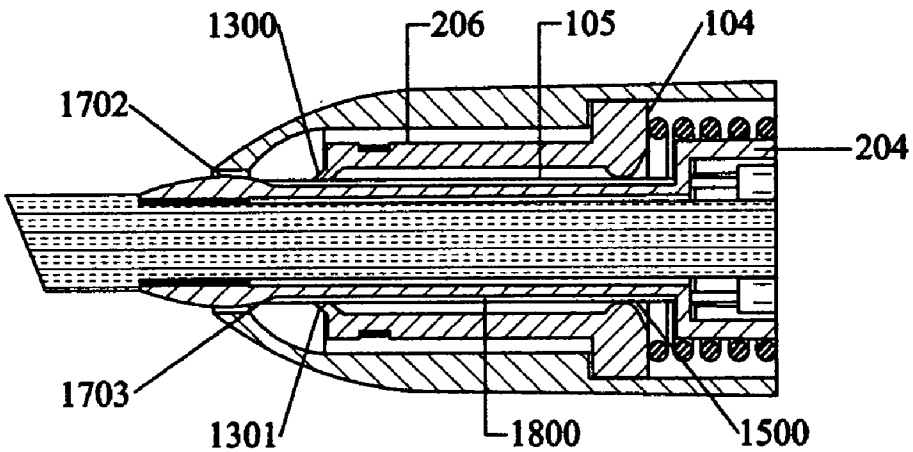
FIG. 18 is an enlarged cross-sectional view of a tip and a cartridge in relation to a valve in the protracted position.

FIG. 18 illustrates an enlarged cross-sectional view of the cartridge 204 in relation to the valve 206 in the protracted position. The third leading section 1703 has an array of cavities 1800 that extend back along the elongated portion 105 to minimize the surface area of the third leading section 1703 and collect fluid residue that is built up on the elongated portion 105 as the elongated portion 105 moves into the valve 206 and collects fluid condensation on the inner surfaces of lips 1300 and 1301. The fluid condensation is forced into the cavities 1800 so that friction caused by fluid build up between the elongated portion 105 and the back end 104 is minimized as the second leading section 1702 moves into the hole 1500 in the back end 104 of valve 206.

Figure 19:
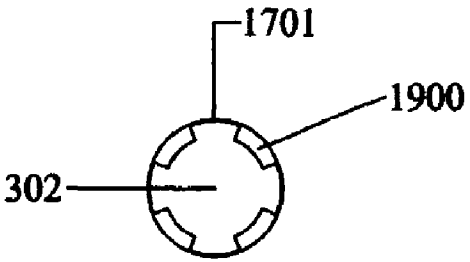
FIG. 19 illustrates a front view of the opening formed in the elongated portion of FIG. 20.

FIG. 19 illustrates a front view of the first opening 302 formed along the first leading section 1701. Within the first opening 302 there may be at least one tooth 1900 adapted to engage with the tip 101 to hold the tip 101 in a predetermined position. FIG. 7 shows an enlarged view of the tip 101, the tip 101 has an edge 700 with a pitch angle to allow the tip 101 to penetrate through the slit 600 more easily. The tooth 1900 inside the opening 302 may hold the tip 101 so that the edge 700 of the tip 101 may be aligned relative to the slit 600. With the valve 206 and the edge 700 aligned and held in a predetermined position, the tip 101 may cycle in and out of the slit 600 without damaging the slit 600.

Figure 20:
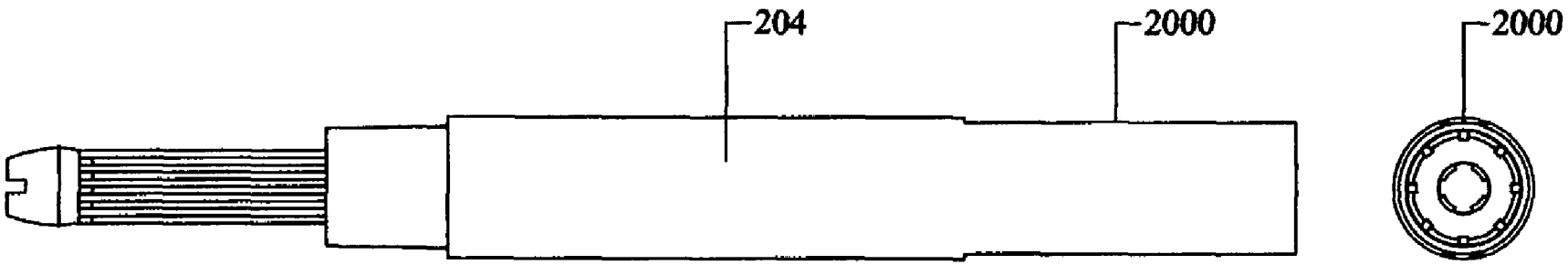
FIG. 20 illustrates a side view of the cartridge.

FIG. 20 illustrates a side view of the cartridge 204 having at least one flat 2000 adapted to engage within the rear barrel 202, the rear barrel 202 adapted to receive the flat for guiding the cartridge 204 along an axially direction without rotating. This also ensures that the edge 700 of the tip 101 protracts consistently in relation to the front and rear barrels 207 and 202. That is, the edge 700 of the tip 101 is substantially prevented from rotating in relation to the front and rear barrels 207 and 202. In embodiments where the writing tool 100 has a side clip on the rear barrel 202 or an asymmetrically shaped outer configuration, having the tip 101 protracted consistently allows a user to hold the writing tool as intended as well.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

The invention claimed is:

1. A retractable writing tool comprising: a rear barrel (202) and a front barrel (207) having an opening (203) and a tip (101) capable of moving between a retracted position and a protracted position; a feeder (107) capable of conveying fluid to the tip (101) and a valve (206) having a front end (103) and a back end (104), where the front end (103) has a round face with a concave shape profile at the point where the tip is to exit and a slit (600), the front end (103) is adjacent to the opening (203) of the front barrel (207) so that in the retracted position the tip (101) is between the front end (103) and the back end (104) substantially sealed from outside air to substantially prevent the writing fluid from evaporating to the outside air, and preventing the release of vapor fluid from within the enclosure (102) when the tip (101) is in a retracted position, where in the protracted position, the tip (101) extends through the slit (600) of the valve (206) and opening (203) of the front barrel (207), where the valve (206) is made of silicone.

2. The valve (206) of claim 1, where the valve (206) is made of rubber.

3. The valve (206) of claim 1, where the valve (206) is made of thermoplastic elastomer.

4. The valve (206) of claim 1, where the valve (206) is treated with fluorine.

5. The valve (206) of claim 1, where the valve (206) is made of thermoplastic vulcanized material including rubber cross linked with polypropylene.

6. The front barrel of claim 1, where the inner circumference of the front barrel (207) is about the same circumference or slightly greater than the outer circumference around the front end (103) of valve (206).

7. The valve (206) of claim 1, where the front end (103) is separated from the inner circumference of the front barrel (207) by an open space.

8. The valve (206) of claim 1, where the back end (104) has a hole (1500) that is adapted to seal around a leading section (1700) of a cartridge (204).

9. The valve (206) of claim 1, where the valve (206) has at least one cavity (901) to position the valve (206) at a predetermined position within the front barrel (207).

10. The front barrel (207) of claim 9, where the front barrel has at least one tab (1600) that is adapted to engage with at least one cavity (901) to position the valve (206) at a predetermined position within the front barrel (207).

11. The cartridge (204) of claim 1, where a cartridge (204) having at least one flat (2000) is adapted to engage within the rear barrel (202), the rear barrel (202) adapted to receive the flat (2000) for guiding the cartridge 204 along an axially direction without rotating.

12. The valve (206) of claim 1, further including a tension device (1000) around the front end (103) to substantially close the slit (600) when the tip (101) is in the retracted position.

13. The tension device (1000) of claim 12, where the tension device (1000) is a ring.

14. The tension device (1000) of claim 12, where the tension device is an elastic band.

15. The valve (206) of claim 1, where the valve (206) is made of thermoplastic vulcanized material including rubber cross linked with polypropylene.

16. The valve (206) of claim 1, where the front end (103) has a concave shape profile with a slit (600) that is formed along the longitudinal axis (301).

17. The valve (206) of claim 1, where the front end (103) has an outer circumference, and further including an array of ribs 91400) along the outer circumference to support the front end (103) to close the slit (600).

18. The valve (206) of claim 1, where the back end (104) has a hole (1500) that is adapted to seal around a second leading section (1702) of a cartridge (204).

* * * * *